US005529865A

United States Patent [19]

Kanbayashi et al.

[11] Patent Number: 5,529,865

[45] Date of Patent: Jun. 25, 1996

[54] IMAGE FORMING METHOD USING DRY COLOR TONER AND PRESS-CONTACT FIXING METHOD

[75] Inventors: Makoto Kanbayashi; Tsuyoshi Takiguchi, both of Kawasaki; Wakashi Iida, Higashikurume, all of Japan

[73] Assignee: Canon Kabushiki Kaisha, Tokyo, Japan

[21] Appl. No.: 254,757

[22] Filed: Jun. 6, 1994

[30] Foreign Application Priority Data

Jun. 11, 1993 [JP] Japan ..... 5-165076
Apr. 27, 1994 [JP] Japan ..... 6-089985

[51] Int. Cl.[6] ..... G03G 13/01

[52] U.S. Cl. ..... 430/45; 430/46

[58] Field of Search ..... 430/45, 46, 106

[56] References Cited

U.S. PATENT DOCUMENTS

| | | | |
|---|---|---|---|
| 4,928,147 | 5/1990 | Baumann et al. | 355/288 |
| 5,009,973 | 4/1991 | Yoshida et al. | 430/45 |
| 5,240,806 | 8/1993 | Tang et al. | 430/45 |

*Primary Examiner*—John Goodrow
*Attorney, Agent, or Firm*—Fitzpatrick, Cella, Harper & Scinto

[57] ABSTRACT

An image forming method includes the steps of: (1) forming a first unfixed image of color toner on one side of a transfer material, wherein the color toner has a weight average particle size of 3 to 7 μm and includes color toner particles having a particle size of 4 μm or less in a range of 10 to 70 by number, color toner particles having a particle size of 5.04 μm or less in a range of 40% by number or more, color toner particles having a particle size of 8 μm or more in a range of 2 to 20% by volume, and color toner particles having a particle size of 10.08 μm or more in a range of 6% by volume or less; (2) heating and melting the color toner of the first unfixed image by heating, pressing and fixing means which includes a rotation body for fixing having an elastic layer to fix the first unfixed image to the one side of the transfer material; (3) forming a second unfixed image of color toner on the other side of the transfer material, wherein the color toner has a weight average particle size of 3 to 7 μm and includes color toner particles having a particle size of 4 μm or less in a range of 10 to 70% by number, color toner particles having a particle size of 5.04 μm or less in a range of 40% by number or more, color toner particles having a particle size of 8 μm or more in a range of 2 to 20% by volume, and color toner particles having a particle size of 10.08 μm or more in a range of 6% by volume or less; and (4) heating and melting a color toner of the second fixed image by the heating, pressing and fixing means to fix the second unfixed image to the other side of the transfer material, whereby color images are formed on both sides of the transfer material.

30 Claims, 2 Drawing Sheets

IMAGE FORMING METHOD USING DRY COLOR TONER AND PRESS-CONTACT FIXING METHOD

BACKGROUND OF THE INVENTION

The present invention relates to an image forming method in which a color image is formed on both sides of a transfer material such as a sheet of plain paper by an electrophotographic system.

DESCRIPTION OF RELATED ART

Generally, for obtaining a full color image, a photoconductor drum is uniformly charged by a primary charger and exposed by a laser beam which is modulated based on a signal depending upon a magenta red color image of a manuscript, such that an electrostatic latent image is formed on the photoconductor drum. The electrostatic latent image is then developed by a magenta red color developing unit having a magenta red color toner such that a magenta red color toner image is formed on the photoconductor drum. Thereafter, the magenta red color toner image on the photoconductor drum is transferred to a carried transfer material by use of a transfer charger so that a transferred magenta red color toner image which is not yet fixed is formed on the transfer material. Next, the charge is removed from the photoconductor drum by a charge-removing charger after the development of the electrostatic latent image and the surface of a photoconductor of the drum is cleaned by cleaning means. Then, the photoconductor drum is charged by the primary charger again. Subsequently, as in the magenta red color toner image process, a cyanine blue color toner image is formed on the photoconductor drum and transferred onto the transfer material on which the magenta red color toner image has been already transferred. Further, a similar operation is repeated for a yellow color toner image and a black color toner image. As a result, four color toner images are transferred onto the transfer material and fixed on the transfer material by application of heat and pressure so that a full color image can be formed on the transfer material.

The various types of color toner used in the above image forming method need to have good meltability in the application of heat and good color mixability between the types of color toner to each other and it is preferable that there is used the sharp-melt type of color toner with a low softening point and a low viscosity at the fusing condition. By using the sharp-melt type of color toner, color reproducibility of a color copy can be widened and a color copy faithful to the original manuscript or a color print can be obtained.

However, such a sharp-melt type of color toner has a characteristic of strong thermal shrinkage after the fixing process and therefore the transfer material tends to curl. Specifically, in a full color image forming apparatus, because a plurality of layers of the magenta red color toner, the cyanine blue color toner, the yellow color toner and the black color toner are formed on the transfer material, the curling easily occurs in and after the fixing process. However, the need increases day by day for a double side copy process, in which images are formed on both sides of a transfer material. Recent requests of various types of copies and efforts to save the consumption of paper reflect a recent ecology boom. That problem becomes more important in fixing an image on the second side of the transfer material.

Under such circumstances, a method has been proposed in which a viscosity of melt color toner is increased, or the speed of the fixing process is increased such that the color toner is not sufficiently melted. However, it is not desirable in either case because the color reproducible region is narrow. Another method has been proposed in which the transfer material is forced by a unit such as a roller after the fixing process of an image on the front surface of the transfer material for preventing the curling of the transfer material in copy of another image on the back surface thereof. In this method, however, because the roller touches the image on the transfer material immediately after the fixing, a mark of the roller is left on the image and the structure of the image forming apparatus becomes complicated.

Therefore, a color image forming method is strongly demanded in which a double sided full color copy can be performed well and easily.

SUMMARY OF THE INVENTION

The present invention has, as an object, to provide a color image forming method in which the above problems can be solved.

Another object of the present invention is to provide an image forming method in which the curling of the transfer material is possibly eliminated after fixing an image on one of the sides of the transfer material such that the transfer material can be smoothly carried to allow an image to be formed on the other side thereof so that color images can be provided on both sides thereof with no defect.

Another object of the present invention is to provide an image forming method in which a good double sided color copy can be obtained without making color reproducibility of the copy narrow.

Furthermore another object of the present invention is to provide an image forming method in which lowering of the image density and fading of the image are not caused even if a color manuscript having a large area is continuously copied.

Still another object of the present invention is to provide an image forming method in which an image has a sharp image property with no fog, and superior durability and stability.

It is an object of the present invention to provide an image forming method, comprising:

forming an unfixed image of color toner on one side of a transfer material, wherein the color toner has a weight average particle size of 3 to 7 μm and includes color toner particles having a particle size of 4 μm or less in a range of 10 to 70% by number, color toner particles having a particle size of 5.04 μm or less in a range of 40% by number or more, color toner particles having a particle size of 8 μm or more in a range of 2 to 20% by volume, and color toner particles having a particle size of 10.08 μm or more in a range of 6% by volume or less;

heating and melting the color toner of the unfixed image by heating and pressure fixing means which includes a rotation body for fixing having an elastic layer to fix the image to the one side of the transfer material;

forming a second unfixed image of color toner on the other side of the transfer material, wherein the color toner has a weight average particle size of 3 to 7 μm and includes color toner particles having a particle size of 4 μm or less in a range of 20 to 70% by number, the color toner particles having a particle size of 5.04 μm or less in a range of 40% by number or more, the color toner particles having a particle size of 8 μm or more in a range of 2 to 20% by volume, and the color toner particles having a particle size of 10.08 μm or more in a range of 6% by volume or less; and heating and melting the color toner of the second unfixed image by heating and pressure fixing means to fix the second image to the other side of the transfer material such that color images can be formed on both sides of the transfer material.

DESCRIPTION OF THE PREFERRED EMBODIMENTS

Figure 1:
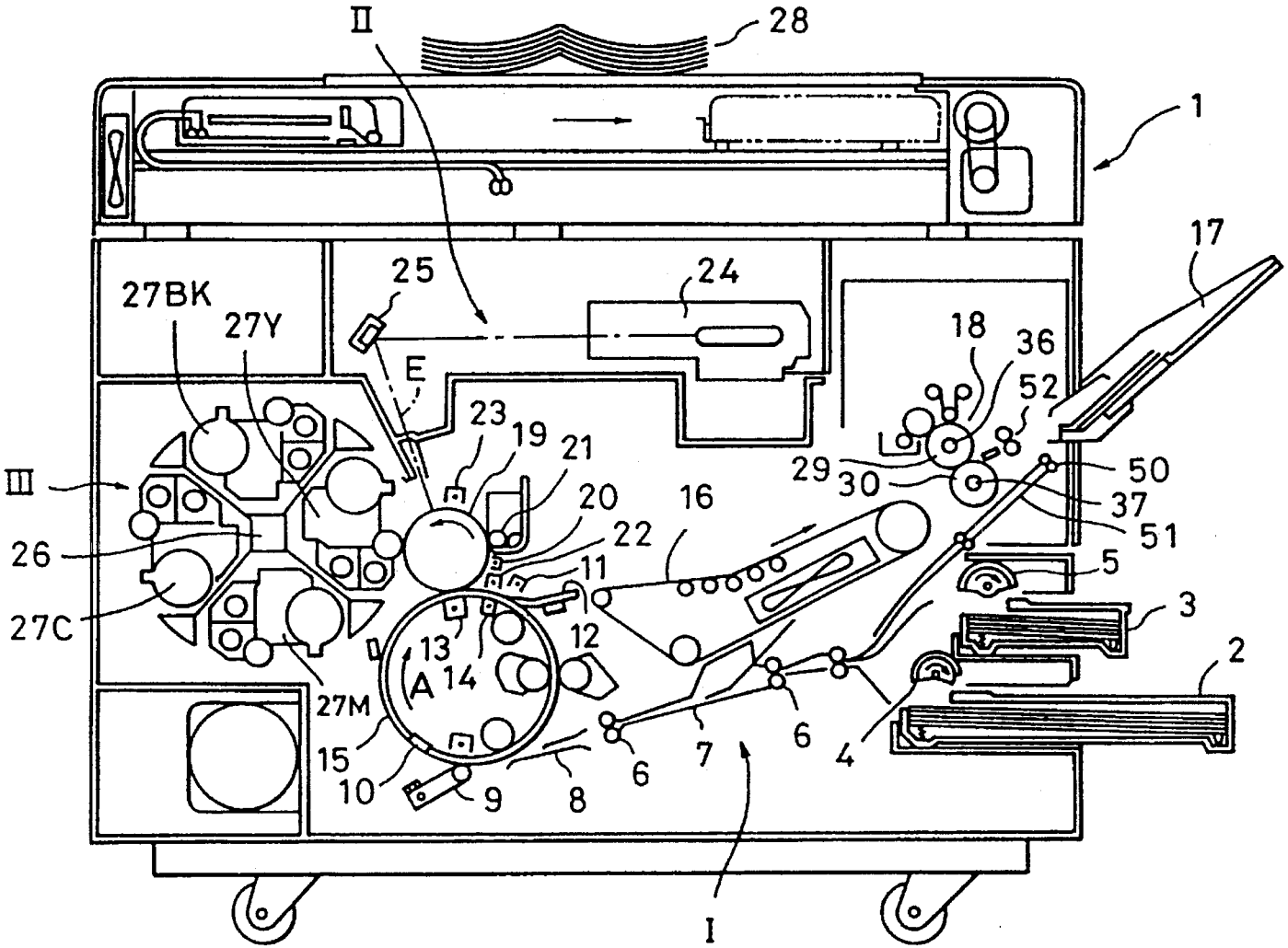
FIG. 1 is a cross sectional view showing a main structure of an image forming apparatus to which an image forming method of the present invention can be applied.

The inventors of the present invention diligently have studied the image density, color reproducibility of highlight and reproducibility of thin lines. As a result of the study, they have determined that development can be performed faithfully for an electrostatic latent image on a photoconductor when color toner has a weight average particle size of 3 to 7 μm, and that the amount of toner having a weight average particle size of 4 μm or less greatly contributes to increasing the reproducibility of highlight. Also, they have determined that for a fixing process of images on both sides of a transfer material, if color toner having the above distribution of toner particle size is used, then the space between toner particles is filled without thickly stacking color toner particles on the transfer material such that the image density can be increased. Accordingly, it is advantageous to not only the curling problem in the fixing process on both sides of the transfer material but also to the cost problem in that it is possible to reduce the toner amount necessary to obtain a predetermined image density.

First, the distribution of toner particle sizes will be described below in detail.

When the weight average particle size of color toner is more than 7 μm, there are very few fine toner particles contributing to the high image quality. This is because it is difficult for such toner particles to adhere to a photoconductor drum faithfully to a fine electrostatic latent image thereon. This results in a lack of reproducibility of a highlight portion and in addition, insufficient resolution. Further, overstacking of toner particles more than an amount required is caused so that the consumption of toner tends to increase.

On the other hand, when the weight average particle size of the color toner is smaller than 3 μm, the image density becomes low because the amount of triboelectric charge per unit weight of the color toner is so extremely high that it is difficult for the toner particles to separate from carrier particles. Specifically, it is remarkable at a low temperature and a low humidity that the image density becomes low. Therefore, such color toner is not suitable for an application such as a graphic image having a high specific surface area. Further, when the weight average particle size of color toner is smaller than 3 μm, because charging of the color toner particles cannot be smoothly performed through contact with carrier particles, the number of toner particles that are not charged up sufficiently increases so that scattering of the toner particles to non-imaging portions and fogging become conspicuous. For coping with this, it could be considered to make the toner particle size small so that the surface area of a carrier particle could be made greater than that of the toner particle. However, in a case of the toner particles having a weight average particle size smaller than 3 μm, self-condensation of the toner particles easily occurs so that a uniform mixture of the toner particles and carrier particles cannot be achieved for a short time. Therefore, fogging tends to appear upon continuous supply of the toner.

For these reasons, the weight average particle size of the color toner is preferably in a range of 3 to 7 μm.

The color toner used in the present invention includes toner particles having a particle size of 4 μm or less in a range of 10 to 70% by number, preferably 15 to 60% by number for all toner particles. When the number of toner particles having a particle size of 4 μm or less is less than 10% by number, there is only a little amount of toner particles having small particle size necessary for high quality image. Specifically, as the color toner is continuously used by repeating a copy or printing, the effective component of toner particles decreases so that the image quality tends to degrade gradually, because the distribution of particle sizes of the color toner changes. Conversely, when color toner having a weight average particle size of 4 μm or less is more than 70% by number, the toner particles condense to each other so that a mass of condensed toner particles acts as a toner particle having a particle size greater than that of the original toner particle. As a result, the image becomes rough, the resolution degrades and the difference in density undesirably becomes greater between an edge portion of a latent image and a center portion thereof, resulting in the image having a slightly faint center portion.

Toner having a particle size of 8 μm or more is preferably in a range of 2 to 20% by volume, and more preferably in a range of 3.0 to 18.0% by volume. If toner particles having a particle size of 8 μm or more are 20% by volume or more, then the image quality is degraded and the toner particles are overstacked on the transfer material, resulting in an increase in the amount of toner consumption. On the other hand, if toner particles having a particle size of 8 μm or more are less than 2% by volume, then the image quality is degraded because of a low fluidity of the toner particles.

In order to further increase the charge capability of the toner particles and the fluidity thereof for further advantages of the present invention, toner particles having a particle size of 5.04 μm or less are included in a range of 40% by number or more, preferably in a range of 40 to 90% by number, more preferably in a range of 40 to 80% by number. In addition, toner particles having a particle size of 10.08 μm or more are included in a range of 6% by volume or less, preferably in a range of 4% by volume or less.

Considering the curling of the transfer material after the fixing process, the greater the amount of toner particles stacked on the transfer material, the more easily the transfer material curls, and the higher the fixing process temperature, the more easily the transfer material curls. Specifically, the curling becomes noticeable in proportion to the amount of toner particles stacked on the transfer material. Because the toner particles have the above-mentioned particle size distribution, a distance between the toner particles on the transfer material can be made narrow before the fixing process so that a high image density can be obtained with a little amount of the toner particles.

In the image forming method of the present invention, the image density required can be satisfied even if the amount of stacked toner particles is decreased. Therefore, the curling of the transfer material can be eliminated so that the transfer material can be smoothly carried for a copy or printing of another color image on the back side of the transfer material, resulting in good formation of the other color image on the back side thereof. When the latent image on the photoconductor drum is developed with a little amount of toner particles, it is advantageous to the transfer operation. There are advantages with respect to decreasing the amount of scattered toner particles and prevention of a faint center portion of the toner image. This is extremely advantageous in obtaining high image quality.

In the image forming method of the present invention, in order to suppress the curling of the transfer material and fogging, the amount of toner particles held on the transfer material in the region of the highest image density is preferably 1 mg/cm$^2$ or less, more preferably 0.8 mg/cm$^2$ or less, in a single color toner. In the case where a toner of three colors of cyanine blue color toner, magenta red color toner and yellow color toner are held on the transfer material, the amount of toner particles held on the transfer material in the region of the highest image density is preferably 2.3 mg/cm$^2$ or less, more preferably 2.0 mg/cm$^2$ or less, and further more preferably 1.8 mg/cm$^2$ or less.

An image forming apparatus which can perform well the image forming method of the present invention will be described below with reference to FIG. 1.

A color electrophotographic apparatus shown in FIG. 1 mainly includes a transfer material carrying system I which is provided from the right side of an apparatus body 1 (the right side of FIG. 1) to substantially the middle portion of the apparatus body 1, a latent image forming section II which is provided at the substantially middle portion close to a transfer drum 15 constituting a part of the transfer material carrying system I, and a developing means, i.e., a rotary developing unit III provided close to the latent image forming section II.

The transfer material carrying system I is constituted as follows. Openings are formed on the right wall of the apparatus body 1 (the right side of FIG. 1) and detachable trays 2 and 3 for supplying the transfer material are provided at the openings to have a part of each of them protruded from the apparatus body 1. Rollers 4 and 5 for supplying sheets of paper are provided at the immediately upper portion of the trays 2 and 3 and a roller 6 for supplying a sheet of paper and guides 7 and 8 for guiding the supplied sheet of paper are provided to link rollers 4 and 5 and the transfer drum 15 rotatable in a direction A and provided at the left side. A contact roller 9, a griper 10, a charger 11 for separating the transfer material, and a separation claw 12 are provided in that order in the neighborhood of the outer surface of the transfer drum 15 in a rotation direction of the drum 15 from the upstream side toward the downstream side. A transfer charger 13 and a charger 14 for separating the transfer material are provided on the side of the inner surface of the transfer drum 15. A transfer sheet (not shown) formed of polymer such as polyvinylidene fluoride is pasted on a portion of the transfer drum 15 on which the transfer material is wound and the transfer material is electrostatically pasted on and fit to the transfer sheet. Carrying belt means 16 is provided on the upper right portion of the transfer drum 15 in the neighborhood of the separation claw 12 and a fixing unit 18 is provided at the end portion of the carrying belt means 16 in the carrying direction of the transfer material (the right end portion). A tray 17 for ejection is provided after the fixing unit 18 in the carrying direction. The tray 17 extends to the outside of the apparatus body 1 and is detachable from the apparatus body 1.

Next, the structure of the latent image forming section II will be described below. A photoconductor drum 19 such as an OPC photoconductor drum which functions as a rotatable latent image holding unit is provided and rotated in the arrow mark direction of FIG. 1 such that the outer surface of the drum 19 contacts the outer surface of the transfer drum 15. A charge removing charger 20, cleaning means 21 and a primary charger 23 are provided in that order in the upper portion of the photoconductor drum 19 in the neighborhood of the outer surface of the drum 19 in the rotation direction of the drum 19 from the upperstream side toward the downstream side. In addition, image exposing means 24 such as a laser beam scanner for forming a latent image on the outer surface of the photoconductor drum 19 and image exposing reflecting means 25 such as a mirror are provided.

The structure of the rotary developing unit III is as follows. A rotatable body 26 (hereinafter to be referred to as "rotation body") is provided in a position opposite to the outer surface of the photoconductor drum 19. Four kinds of developing units are mounted in the rotation body 26 at four positions in the circumferential direction of rotation body 26, respectively, and an electrostatic latent image formed on the outer surface of the photoconductor drum 19 is visualized or developed. The four kinds of developing units include a yellow developing unit 27Y, a magenta red developing unit 27M, a cyanine blue developing unit 27C and a black developing unit 27BK.

An operation sequence of the whole image forming apparatus constituted as described above will be described taking the sequence in a full color mode as an example.

When the above-mentioned photoconductor drum 19 is rotated in the arrow mark direction of FIG. 1, the photoconductor on the drum 19 is charged up by the primary charger 23. In the apparatus shown in FIG. 1, an operation speed of each section (hereinafter to be referred to as "a process speed") is faster than 100 mm/sec., e.g., in a range of 130 to 250 mm/sec. If charging is performed for the photoconductor drum 19 by the primary charger 23, then image exposure is performed by use of a laser beam E which is modulated in accordance with a yellow color image signal from a manuscript 28 so that an electrostatic latent image is formed on the photoconductor drum 19. Then, development is performed for the electrostatic latent image by the yellow developing unit 27Y which is positioned at a predetermined position as the result of the rotation of the rotation body 26, resulting in the formation of a yellow toner image.

A transfer material carried via the sheet supplying guide 7, the sheet supplying roller 6 and a sheet supplying guide 8 is held or gripped by the gripper at a predetermined timing and is electrostatically wound in the transfer drum 15 by the contacting roller 9 and an electrode opposing the roller 9. The transfer drum 15 is rotated synchronously with the photoconductor drum 19 in the arrow mark direction and the yellow toner image formed by the yellow developing unit 27Y is transferred to the transfer material by use of the transfer charger 13 at the portion where the outer surface of the photoconductor drum 19 contacts the transfer drum 15. The transfer drum 15 continues to rotate with no change to prepare the transfer of the next color (magenta red in FIG. 1).

The charge on the photoconductor drum 19 is removed by the charge removing charger 20 and the drum 19 is cleaned by the cleaning means 21 having a cleaning blade. Thereafter, the photoconductor drum 19 is charged up by the primary charger 23 again and image exposure is performed based on the next magenta red image signal so that an electrostatic latent image is formed. The rotary developing unit is rotated while the electrostatic latent image is formed through the image exposure based on the magenta red image signal to position the magenta red developing unit 27M at the predetermined developing position so that development can be performed by use of the predetermined magenta red color toner. Subsequently, the processes mentioned above are performed for the cyanine blue color and black color. When the transfer of four color toner images is completed, the charge is removed from the four color transferred images formed on the transfer material by the chargers 22 and 14. Also, the gripping of the transfer material by the gripper 10 is released and the transfer material is separated from the transfer drum 15 by the separation claw 12 to be carried to the fixing unit 18 by the carrying belt 16 so that the transferred images are fixed by heating and pressing. In this manner, the sequence of full color print ends and a predetermined full color print image is formed on one side of the transfer material. At this time, the fixing operation speed at the fixing unit 18 is, for example, 90 mm/sec. and slower than the process speed of the apparatus body 1, e.g., 160 mm/sec. This is because sufficient heat needs to be applied to the toner particles adhered on the transfer material in order to melt and mix the toner particles in the two to four laminated layers of the unfixed images. The heat amount is increased by performing the fixing process at a speed slower than that of the development.

Figure 2:
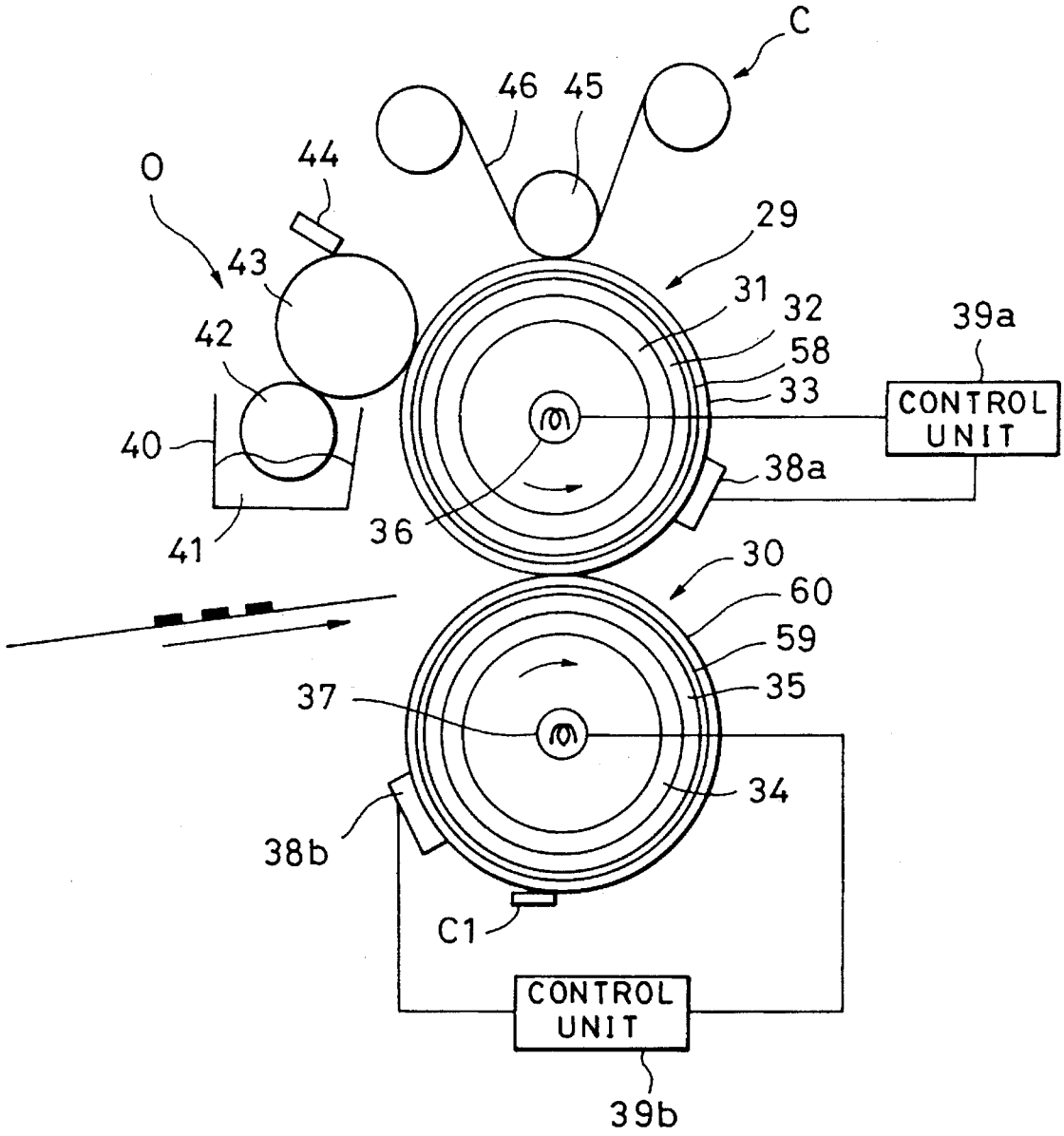
FIG. 2 is a cross sectional view showing a main structure of a fixing unit provided in the image forming apparatus shown in FIG. 1.

In FIG. 2, the fixing roller 29 (fixing means) has a diameter of 60 mm and includes a core layer 31 of 5 mm in thickness and made of aluminum, a RTV (room temperature vulcanization type) silicone rubber layer 32 of 2 mm in thickness which is provided on the layer 31, a fluoro-rubber layer 58 of 50 μm in thickness which is provided on the layer 32, and an HTV (high temperature vulcanization type) silicone rubber layer 33 of 230 μm which is provided on the layer 32, for example. The pressing roller 30 (pressing means) has a diameter of 60 mm and includes a core layer 34 of 5 mm in thickness made of aluminum, a RTV silicone rubber layer 35 of 2 mm in thickness which is provided on the layer 34, a fluoro-rubber layer 59 of 50 μm in thickness which is provided on the layer 35, and a HTV silicone rubber layer 33 of 230 μm which is provided on the layer 59. The fixing roller 29 is provided with a halogen heater 36 (heating means) and the pressing roller 30 is provided with a halogen heater 37. As a result of this, the transfer material is heated up by both rollers 29 and 30. The temperatures of the fixing roller 29 and the pressing roller are detected by thermistors **38*a* and 38*b* provided to contact the fixing roller 29 and the pressing roller 30 and the halogen heaters 36 and 37 are controlled by control units 39*a* and 39*b* based on the detected temperatures such that the temperatures of the fixing roller 29 and the pressing roller 30 are kept in a predetermined temperature range, e.g., in a range of 160 ° C.±10° C., respectively. The fixing roller 29 and the pressing roller 30** are pressed to each other by a pressing mechanism (not shown) with a total pressure of 40 kg.

In FIG. 2, "O" denotes an oil coating unit (releasing agent coating means), where "C" denotes a cleaning unit, and "Cl" denotes a cleaning blade for removing oil and contamination adhered to the pressing roller 30. The oil coating unit coats dimethyl silicone oil 41 (for example, KF96 300 cs available from SHINETSU KAGAKU) in an oil pan 40 via an oil drawing roller 42 and an oil coating roller 43 while the amount of coated oil is restricted by a blade 44 for adjusting the amount of coated oil. The cleaning unit C presses a non-woven fabric web composed of NORMEX to the fixing roller 29 by a pressing roller 45 to clean it. The web is rolled up by a rolling unit (not shown) at a proper timing in such a manner that the toner is not collected on a portion contacting the fixing roller 29.

The transfer material on one of whose surfaces a full color image is formed is sent to the ejection tray 17 by an ejecting roller 52. A sheet resupplying roller 50 is provided below the ejecting roller 52 to supply a transfer material ejected once onto the ejection tray 17 to the latent image forming section II again, and a carriage path 51 is provided after the sheet resupplying roller 50 to carry the transfer material. The transfer material on the ejection tray 17 is supplied again by the sheet resupplying roller 50 to pass through the carriage path 51 and to be carried to the latent image forming section II so that a color image is formed on the back surface of the transfer material in the same manner as on the front surface. Thus, the transfer material having a color image already fixed on the front surface and a second color image not yet fixed on the back surface is carried to the fixing roller 29 and the pressing roller 30 by the carrying belt means 16 to be subject to the fixing process, and is finally carried to the ejection tray 17. In this manner, both sides color cop is completed.

In a case where a color copy or a full color copy is performed for both surfaces of the transfer material, the curling of the transfer material tends to be caused when the first image forming operation is completed to heat and fix the first toner image on the transfer material. If the transfer material curls greatly, then the transfer material stops at the section of the sheet resupplying roller so that the transfer material cannot be carried smoothly. In addition, because the transfer material cannot be sufficiently wound on the transfer drum, a second color image of good quality cannot be formed on the back surface of the transfer material. Therefore, in the case where color images, specifically full color images, are formed on both surfaces of the transfer material, it is extremely important to suppress the curling of the transfer material.

The color toner used in the present invention is manufactured to contain coloring agent in a binding resin. The component of the color toner will be described below. Various types of resin which are well known for conventional electrophotographic toner are used for the binding resin of the color toner. For instance, there are polystyrene, styrene-butadiene copolymer, a styrene copolymer such as styrene-acrylic copolymer, polyethylene, ethylene-vinyl acetate copolymer, ethylene copolymer such as ethylene-vinyl alcohol copolymer, phenol resin, epoxy resin, acryl phthalate resin, polyamide resin, polyester resin, and maleic resin. When the polyester resin having a specially high value of negatively charged capability is selected and used from among these types of resins, a great advantage can be obtained in the present invention. A resin of this polyester group has a superior fixing characteristic so that it is suitable for color toner. Preferably, the polyester resin obtained by performing co-condensation-polymerization for bisphenol derivative is represented by the following chemical formula or its substituent as a diole component and carboxylic acid component such as fumaric acid, maleic acid, maleic acid anhydride, phthalic acid, terephthalic acid, trimellitic acid and pyromellitic acid composed of carboxylic acid except for monocarboxylic acid, carboxylic acid anhydride or its lower alkylester because it has a sharp melting characteristic.

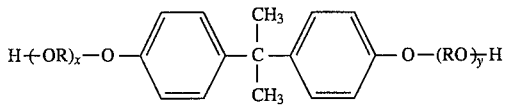

Specifically, the polyester resin has an apparent viscosity in a range of $5\times10^4$ to $5\times10^6$ poise, preferably in a range of $7.5\times10^4$ to $2\times10^6$ poise, and more preferably in a range of $1\times10^5$ to $1\times10^6$ poise, at a temperature of 90° C., and an apparent viscosity in a range of $1\times10^4$ to $5\times10^5$ poise, preferably in a range of $1\times10^4$ to $3\times10^5$ poise, and more preferably in a range of $1\times10^4$ to $2\times10^5$ poise, at a temperature of 100° C., so that good results are obtained in fixability, color mixing capability and high temperature proof offset capability as the full color toner. In this case, the absolute value of the difference between the apparent viscosity P1 at 90° C. and the apparent viscosity P2 at 100° C. is preferably in a range of $2\times10^5<|P1-P2|<4\times10^6$.

Well known dyes or pigments can be used as the coloring agent for the color toner in the present invention. For instance, there are C.I. Pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209; C.I. Pigment violet 19; and C.I. vat red 1, 2, 10, 13, 15, 23, 29 and 35, as magenta red color pigment. The dye and pigment may be used singly but it is preferable to use a plurality of types of dye and pigment for increasing the sharpness of the image with respect to the high quality full color image.

Dyes for the magenta red color include C.I. solvent red 1, 3, 8, 23, 24, 25, 27, 30, 49, 81, 82, 83, 84, 100, 109 and 121; C.I. dispersed red 9; C.I. solvent violet 8, 13, 14, 21 and 27; oil soluble dyes such as C.I. dispersed violet 1; C.I. basic red 1, 2, 9, 12, 13, 14, 15, 17, 18, 22, 23, 24, 27, 29, 32, 34, 35, 36, 37, 38, 39 and 40; and basic dye such as C.I. basic violet 1, 2, 7, 10, 14, 15, 21, 25, 26, 27 and 28.

Coloring agents for the cyanine blue color include C.I. pigment blue 2, 3, 15, 16 and 17; C.I. vat blue 6; C.I. acid blue and copper phthalocyanine pigment obtained by replacing phthalocyanine skeleton having the structure shown in the following chemical formula (1) by one to five phthalimide methyl groups:

(1)

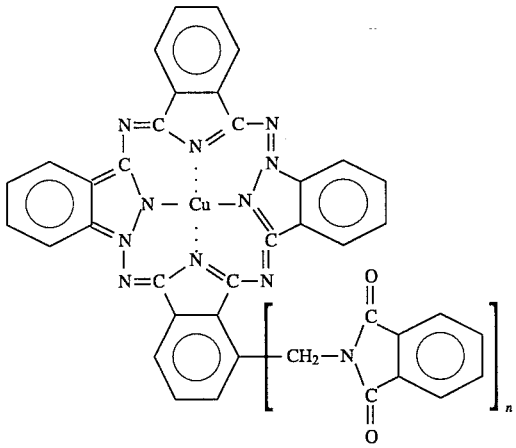

n = 1 ~ 5

The coloring agents for the yellow color include C.I. pigment yellow 1, 2, 3, 4, 5, 6, 7, 10, 11, 12, 13, 14, 15, 16, 17, 23, 65, 73 and 83; and C.I. vat yellow 1, 3 and 20.

The weight ratio of the binding agent and the coloring agent is in a range of 100:0.5 to 100:15 and more preferably in a range of 100:0.5 to 100:10.

The color toner used in the present invention is not limited to toner having a negatively charged capability but it may have a positively charged capability. In the case of a toner having a negatively charged capability, it is preferable to add a charging control agent for stabilizing the negatively charged capability. The negatively charging control agent is an organic metal complex such as a metal complex of alkyl-substituted salicylic acid, e.g., a chrome complex or zinc complex of di-tertiary-butyl salicylate, for example. In the case of a color toner having a positively charged capability, it is desirable to use a binding agent in which aminocarbonate esters containing an amino group such as dimethyl aminomethyl methacrylate, which has a positively charged capability, is used as monomer in a range of 0.1 to 40 mol %, preferably in a range of 1 to 30 mol %, or to use a non-colored or light colored positively charging control agent which does not influence to the tone of the toner.

The color toner particles used in the present invention are prepared by sufficiently mixing thermoplastic binding resin and a dye or pigment as a coloring agent, and a charging control agent and an additive agent, if necessary, by a mixer such as a ball mill, by melting and kneading the mixed resin and agent by a thermokneader such as a heating roller, a kneader and an extruder, to disperse or solve a dye or pigment in the melt and kneaded resin, and by breaking and strictly classifying the kneaded resin after cooling and solidifying of the kneaded resin.

Further, in the present invention, it is preferable to use titanium oxide fine powder as the external additive agent. Specifically, the titanium oxide fine powder for which surface treatment is performed by use of a coupling agent is extremely effective in the stability of charging and the capability of giving fluidity. This cannot be attained by hydrophobic silica fine powder which is well known as a fluidity increasing agent. This is because the silica fine powder has a high-level negatively charged capability but the titanium oxide fine powder has a substantially neutrally charged capability.

As a result of a diligent study on the stability of charged capability of the toner, the inventors have determined that titanium oxide fine powder having an average particle size in a range of 0.01 to 0.2 μm, preferably in a range of 0.01 to 0.1 μm, and more preferably in a range of 0.01 to 0.07 μm, a hydrophobicity of 20 to 98%, and a light transmittance of 40% or more at the wavelength of 400 nm is extremely effective in the stability of a charging operation to the toner and the capability of giving fluidity to the toner. The coupling agents used are silane coupling agent and titanium coupling agent. A silane coupling agent is preferably used. The silane coupling agent having the following general chemical formula is preferable:

$$R_m \text{ Is } Y_n$$

where R is an alcoxy group, m is an integer in the range of 1 to 3, Y is a hydrocarbon group such as an alkyl group, a vinyl group, a glycidoxy group and a methacryl group, and n is an integer in the range of 1 to 3 (it should be noted that m+n is 4). For instance, there are vinyl trimethoxy silane, vinyl triethoxy silane, τ-methacryloxypropyl trimethoxy silane, vinyl triacethoxy silane, methyl trimethoxy silane, methyl triethoxy silane, isobutyl trimethoxy silane, dimethyl dimethoxy silane, dimethyl diethoxy silane, trimethyl methoxy silane, hydroxy propyl trimethoxy silane, phenyl trimethoxy silane, n-hexadecyl trimethoxy silane, and n-octadecyl trimethoxy silane. The specifically desirable silane coupling agent is a compound indicated by the following chemical formula:

$C_{\alpha}H_{2\alpha+1}$–Is–$(OC_{\beta}H_{2\beta+1})_3$ where α is an integer in the range of 4 to 12 and β is an integer in the range of 1 to 3. If α is smaller than 4, then the treatment for achieving the hydrophobicity is easy but the hydrophobicity is low. On the other hand, if α is greater than 13, then the hydrophobicity is sufficient but the condensation of titanium oxide particles becomes active so that the capability of providing the necessary fluidity tends to decrease. If β is greater than 3, then the reactivity decreases so that it is difficult to attain sufficient hydrophobicity. Therefore, α is preferably in a range of 4 to 8 and β is preferably in a range of 1 to 2.

The silane coupling agent is in the range of 1 to 50 weight ratio, preferably in the range of 3 to 40 weight ratio for the titanium oxide fine powder of 100 weight ratio. The treated titanium oxide has a hydrophobicity in the range of 20 to 98%, preferably in the range of 30 to 90%, and more preferably in the range of 40 to 80%. If the hydrophobicity is smaller than 20%, then the charge amount tends to decrease when it is stored under high humidity for a long time. On the other hand, if the hydrophobicity is greater than 98%, then it becomes difficult to control the charging of the titanium oxide, so that the toner is easily charged up under a low humidity. The average particle size of the hydrophobic titanium oxide is preferably in the range of 0.01 to 0.2 μm, more preferably in the range of 0.01 to 0.1 μm, and further more preferably in the range of 0.01 to 0.07 μm with respect to providing necessary fluidity to the toner. If the average particle size of the titanium oxide powder is greater than 0.2 μm, then the fluidity is decreased. If it is smaller than 0.01 μm, then the titanium oxide particles are easily buried in the surface of toner particles so that the durability of the toner tends to decrease. This tendency is remarkable in color toner having a sharp-melt property. The particle size of the titanium oxide is measured by a transmission type electron microscope in the present invention. Further, the light transmittance of the treated titanium oxide is preferably in the range of 40% or more at the wavelength of 400 nm.

Titanium oxide is desirably used in the present invention and has a primary particle size of 0.01 to 0.2 μm. However, when the titanium oxide powder is mixed and added to the toner, the primary particles are not always dispersed and exist in a secondary particle form. Therefore, even if the particle size of the primary particle is small, when an effective particle size in behavior of the primary particles as the secondary particles is large, the advantage of the addition of the titanium oxide powder is greatly decreased. Titanium oxide has a high light transmittance at the wavelength of 400 nm which is a lower limit of the visible region. Thus, when the powder is distributed in a liquid phase and has a small secondary particle size, a good result can be obtained in the capability of providing necessary fluidity to the toner particles and sharpness of projection image of OHP in the color toner. The reason why 400 nm is selected is that it is in a boundary region between the visible region and the ultraviolet region and that a particle having a particle size of a half of the wavelength of light or less transmits the light. Thus, of course, the light transmittance for light having a wavelength longer than that of the light is great and it is not so important.

In order to obtain hydrophobic titanium oxide fine powder, a method is preferably employed in which volatile titanium alcoxide is oxidized at a low temperature to obtain spherical titanium oxide and then a surface treatment is performed to obtain amorphous spherical titanium oxide.

The smaller the particle size of the toner particles, the more the surface area of the toner particles per unit weight increases, and as a result of this, the toner particles are easily overcharged with friction. The hydrophobic titanium oxide fine powder is preferably an external additive agent because it suppresses the overcharging of the toner with friction but gives good fluidity to the toner.

Further, because the hydrophobic titanium oxide fine powder externally added to the toner has a higher capability of absorption of silicone oil adhered to the surface of a color image in the fixing process than that of the hydrophobic silica fine powder, the surface of the transfer drum 15 is less contaminated with the silicone oil adhered to the surface of the transfer material when a color toner image is transferred to the back surface of the transfer material. Therefore, the surface of the photoconductor drum 19 contacting the transfer drum 15 is also less contaminated with the silicone oil.

The hydrophobic titanium oxide in a range of 0.5 to 5 weight %, preferably in a range of 0.7 to 3 weight %, and more preferably in a range of 1.0 to 2.5 weight % is added and mixed to the color toner. The mixture of color toner and fluidizing agent such as the hydrophobic titanium oxide fine powder is desirably performed by a mixer such as the Henschel mixer.

In the case where a two-component type color toner is used as the developer, the toner is mixed with carrier particles. The carrier particles that can be used are particles of metal such as surface oxidized or non-oxidized iron, nickel, copper, cobalt, manganese, chrome and rare earth metal, particles of an alloy of some of these metals, oxide particles, and ferrite particles. Coated carrier particles whose surfaces are coated by resin are specifically preferable in a developing method in which an alternative bias is applied to a developing sleeve. As a coating method can be applied the well known conventional method in which a coating solution prepared by dissolving or suspending a coating material such as a resin in a solvent is coated to the surfaces of core particles of the carrier, or in which the powder of the carrier core particles and the powder of coating material are mixed. The coating materials for the carrier core particle surface are available materials such as polytetrafluoroethylene, monochloro-trifluoroethylene copolymer, polyvinylidene fluoride, silicone resin, polyester type resin, styrene type resin, acrylic type resin, polyamide, polyvinyl butyral, aminoacrylate resin, basic dye and its rake, silica fine powder and alumina fine powder. These materials are used singly or in combination. The coating material is preferably in a range of 0.1 to 30 weight %, more preferably in a range of 0.5 to 20 weight %, for the carrier core particles. In this case, the average particle size of the carrier is preferably in the range of 10 to 100 μm, more preferably in the range of 20 to 70 μm.

The specifically preferable embodiment of the coating material is a ferrite particle of three elements of Cu, Zn and Fe, the surface of which particle is coated with resin such as fluororesin or styrene type resin. For instance, there are used the composition of polyvinylidene fluoride and styrene-methylmethacrylate resin, the composition of polytetrafluoroethylene and styrene-methylmethacrylate resin, or the composition of fluoric copolymer and styrene type copolymer. The composition ratio of the fluoric resin and the styrene type resin are 90:10 to 20:80, preferable 70:30 to 30:70 in weight. The coating material is in the range of 0.01 to 5 weight %, preferably in the range of 0.1 to 1 weight % for carrier core particles. The resin is desirably coated on the magnetic ferrite carrier having an average particle size in the range of 10 to 100 μm, preferably in the range of 20 to 70 μm, including carrier particles of 250 mesh-pass and 400 mesh-on, and more than 70 weight %. As the fluoric copolymer is exemplified vinylidene fluoride-tetrafluoroethylene copolymer (10:90 to 90:10) and as the styrene type resin is exemplified styrene-acrylate 2-ethylhexyl (20:80 to 80:20) or styrene-acrylate 2-ethyhexyl-methylmethacrylate (20 to 60:5 to 30:10 to 50). The above coated magnetic ferrite carrier preferably has a sharp distribution of particle size and a desirable friction charging property to the toner of the present invention, so that it can increase the electrophotographic property of the developing agent of a 2-component system.

The composition ratio of color toner and carrier is preferably in a range of 2 to 15 weight %, preferably in a range of 4 to 13 weight % if it is expressed as the color toner concentration in the developing agent, and in this case a good result can be obtained.

The measuring method of each characteristic will be described below.

Measurement of Distribution of Toner Particle Size

The Coulter counter-TA-II or Coulter multisizer-II (available from Coulter) is used as a measuring equipment. NaCl aqueous solution of about 1% is prepared as electrolyte solution by use of extra pure sodium chloride. For instance, ISOTON-II (available from Coulter Scientific Japan Co. Ltd.) can be used. For the measurement, surface active agent (preferably, alkyl benzene sulfonated salt) of 0.1 to 5 ml is added to the above electrolyte solution of 100 to 150 ml as a dispersing agent and further a measuring sample of 2 to 20 mg is added thereto. The electrolyte solution in which the sample is suspended is subjected to a dispersing process by an ultrasonic disperser for one to three minutes and then the volume and number of the toner particles is measured by the above measuring equipment by use of 100 μm aperture to obtain the distributions of volumes and numbers of the toner particles. Thereafter, the weight average particle size of the toner (D4) (the center value of each channel is set at a representative value of the channel) is determined for weight reference determined from the volume distribution of the toner particles. There are 13 channels used of 2.00 to 2.52 μm, 2.42 to 3.17 μm, 3.17 to 4.00 μm, 5.04 to 6.35 μm, 6.35 to 8.00 μm, 8.00 to 10.08 μm 10.08 to 12.70 μm, 12.70 to 16.00 μm, 16.00 to 20.20 μm, 20.20 to 25.40 μm, 25.40 to 32.00 μm and 32.00 to 40.30 μm, respectively Measurement of Apparent Viscosity The flow tester CFT-500 (SHIMAZU) is used. A sample of 60 mesh pass is weighed at about 1.0 to 1.5 g. This sample is pressed by a molding machine with a pressure of 100 kg/cm$^3$. This pressed sample is measured by the flow tester under ordinary temperature and humidity (at a temperature of 20° to 30° C. and a relative humidity of 30 to 70% RH) under the following conditions to obtain the temperature-apparent viscosity curve. The apparent viscosities at 90° C. and 100° C. determined from the obtained smooth curve are set as the apparent viscosities of the sample.

| | |
|---|---|
| RATE TEMP. | 6.0 deg./min. (°C. 1 min.) |
| SET TEMP. | 70.0 deg. (°C.) |
| MAX TEMP. | 200.0 deg. |
| INTERVAL | 3.0 deg. |
| PREHEAT | 300.0 deg. |
| LOAD | 20.0 kg |
| DIE (DIA) | 1.0 mm |
| DIE (LENGTH) | 1.0 mm |
| PLUNGER | 1.0 cm$^2$ |

Measurement of Hydrophobicity

A methanol titration test is an experimental test for confirming the hydrophobicity of the titanium oxide fine powder having a hydrophobic surface. In order to evaluate the hydrophobicity of treated titanium oxide fine powder, the "methanol titration test" defined in this specification is performed as follows. A sample of titanium oxide fine powder of 0.2 g is added to water of 50 ml in a beaker. The methanol is titrated from a buret until the entire amount of titanium oxide is wetted. During this time, the solution in the beaker is always agitated by a magnetic stirrer. The hydrophobicity is observed when the entire amount of the titanium oxide fine powder is suspended in the solution, and is represented as a percent ratio of methanol in the liquid composition of the methanol and water.

Measurement of Light Transmittance

| | |
|---|---|
| sample | 0.10 g |
| alkyd resin | 13.20 *1 |
| melamine resin | 3.30 *2 |
| thinner | 3.50 *3 |
| glassmedia | 50.00 |

*1: Beccosole 1323-60-EL available from Dainihoninki**
*2: Super Beccamin J-820-60 available from Dainihoninki
*3: Amirak thinner available from Kansaipaint The above mixture of 150 cc is placed in a glass beaker and dispersed for one hour by a Paint Conditioner available from Red Devil. After dispersion, the dispersed mixture is coated on a PET film by a doctor blade of 2 mil. This is heated by baking at 120° C. for 10 minutes and then the light transmittance is measured in a range of 320–800 nm by an U-BEST available from NIHON BUNKOH for comparison.

EXAMPLE 1

Polyester resin obtained by condensing propoxylated bisphenol and fumaric acid, phthalocyanine pigment (C.I. Pigment Blue 15:3) and chrome complex salt of di-tertiary-butyl salicylate were prepared with 100 weight ratio:6 weight ratio:4 weight ratio. The above materials were preliminary mixed by a Henschel mixer sufficiently, melted and mixed by an extruding machine of a two-axle system, roughly crushed into blocks of 1 to 2 mm by a hammer mill after being cooled, and then finely ground by a grinding machine of an air jet system. Further, the obtained powder was classified by a multidivision classifying apparatus to simultaneously and strictly separate very fine particles and coarse particles so that a cyanine blue color toner of a weight average particle size of 6.1 μm was obtained with toner particles of 4 μm or less in particle size being 15.9% by number, toner particles of 5.04 μm or less in particle size being 40.2% by number, toner particles of 8 μm or more in particle size being 7.3% by volume, and toner particles of 10.08 μm or more in particle size being 1.0% by volume.

On the other hand, hydrophilic titanium oxide fine powder (average particle size of 0.02 μm and BET ratio surface area of 140 m$^2$/g) of 100 weight ratio was subjected to a surface treatment by use of n—$C_4H_9$—Si—$(OCH_3)_3$ of 20 weight ratio so that hydrophobic titanium oxide was obtained with the average particle size of 0.02 μm, hydrophobicity of 70%, and light transmittance of 60% at the wavelength of 400 nm.

The cyanine blue color toner was prepared by mixing a cyanine blue color toner of 98.5 weight ratio and the hydrophobic titanium oxide fine powder of 1.5 weight ratio such that the cyanine blue color toner and the hydrophobic titanium oxide fine powder on the surface thereof. The cyanine blue color toner had an apparent viscosity of $5\times10^5$ poise at a temperature of 90° C. and an apparent viscosity of $5\times10^4$ poise at a temperature of 100° C.

The two component type developer was prepared by mixing the above cyanine blue color toner of 5 weight ratio and coating magnetic ferrite carrier of 95 weight ratio. The two component type developer was provided in the cyanine blue color developing unit 27C of the double sided full color copier shown in FIG. 1 which had a developing unit shown in FIG. 2 and was tested for image coloring by use of sheets of plain paper having A4 size (80 g/m$^2$) as the transfer material. Under the circumstance of a temperature of 23° C. and a humidity of 65% RH, the image coloring test was performed on conditions of a development contrast of 320 V, a process speed of 160 mm/sec., a fixing speed of 90 mm/sec., a surface temperature of the fixing roller of 160° C.±10° C. and a surface temperature of the pressing roller of 160° C.±10° C. while dimethyl silicone oil was being coated on the surface of the fixing roller. A cyanine blue color toner image was transferred to a front surface side of the sheet of plain paper from the photoconductor drum 19 and the sheet of plain paper having the cyanine blue color toner image not yet fixed was separated from the transfer drum 15 and carried to the fixing unit 18 so that the cyanine blue color toner image not yet fixed was fixed on the sheet of plain paper through the heating and pressing process. The amount of cyanine blue color toner held in the highest density region on the sheet of plain paper was 0.75 mg/cm$^2$ and a color image of a good quality having a high image density could be obtained with an image density of 1.8 to 2.0. Even if the sheet of plain paper passed through the fixing unit, curling of the sheet of plain paper was very little and the amount of dimethyl silicone oil was also very little on the cyanine blue color image. Because the sheet of plain paper having the cyanine blue color image on the front surface was less curled, it was smoothly carried to the transfer drum 15 via carriage path 51 and was would on the transfer drum 15 in such a manner that the back surface of the sheet of plain paper was faced up. As with the front surface, another cyanine blue color image was transferred on the back surface of the sheet of plain paper and the sheet of plain paper having the other cyanine blue color toner image on the back surface was carried to the fixing unit and fixed there to obtain the other cyanine blue color toner image. The second cyanine blue color image was as good as that on the front surface.

Cyanine blue color images were copied on both the front and back surfaces of 10000 sheets of plain paper. In this case, carriage fault and transfer fault were not caused with respect to the normal sheets of paper and contamination of the surfaces of the transfer drum and the photoconductor drum by dimethyl silicone oil was very little. In addition, offset development was not caused in the heating/pressing and fixing process for not only the front surface of the sheet of plain paper but also the back surface thereof.

EXAMPLE 2

The same processes as in example 1 were performed by use of quinacridone pigment (C.I. Pigment Red 122) in place of phtalocyanine pigment so that a magenta red color toner of a weight average particle size of 6.2 μm was obtained with toner particles of 4 μm or less in particle size being 21.2% by number, toner particles of 5.04 μm or less in particle size being 50.6% by number, toner particles of 8 μm or more in particle size being 10.2% by volume, and toner particles of 10.08 μm or more in particle size being 1.4% by volume. Next, as in example 1, there was prepared a two component type developer of the magenta red color toner and hydrophobic titanium oxide fine powder added thereto. The magenta red color toner had an apparent viscosity of $5\times10^5$ poise at a temperature of 90° C. and an apparent viscosity of $4\times10^4$ poise at the temperature of 100° C.

Similarly, the same processes as in example 1 were performed by use of C.I. Pigment yellow 17 of 4 weight ratio in place of phtalocyanine pigment so that yellow color toner of the weight average particle size of 5.8 μm was obtained with toner particles of 4 μm or less in particle size being 20.3% by number, toner particles of 5.04 μm or less in particle size being 48.6% by number, toner particles of 8 μm or more in particle size being 5.2% by volume, and toner particles of 10.08 μm or more in particle size being 0.2% by volume. Next, as in example 1, there was prepared a two component type developer of the yellow color toner and hydrophobic titanium oxide fine powder added thereto. The yellow color toner had an apparent viscosity of $5\times10^5$ poise at a temperature of 90° C. and an apparent viscosity of $4\times10^4$ poise at a temperature of 100° C.

A two component type developer, which was prepared as in example 1, having the cyanine blue color toner and the hydrophobic titanium oxide fine powder added thereto was provided in the cyanine blue color developing unit 27C, and the developers prepared above were provided in the magenta red color developing unit 27M and the yellow color developing unit 27Y, respectively. In a full color mode, a cyanine blue color toner image, a magenta red color image and a yellow color image were transferred to a front surface side of the sheet of plain paper and the unfixed color toner images were fixed on the front surface of the sheet of plain paper through the heating, pressing and fixing process by the fixing unit as in example 1 so that a full color image was obtained. The total amount of the cyanine blue color toner, the magenta red color toner and, the yellow color toner held in the highest density region on the sheet of plain paper was 1.75 mg/cm$^2$ and a color image faithful to the original manuscript could be obtained. Even if the sheet of plain paper passed through the fixing unit, the curling of a sheet of plain paper was very little and the amount of dimethyl silicone oil was also very little on the full color image. Because the sheet of plain paper having the full color image on the front surface was less curled, it was smoothly carried to the transfer drum 15 via the carriage path 51 and was would on the transfer drum 15 in such a manner that the back surface of the sheet of plain paper was faced up. As with the front surface, another cyanine blue color image, another magenta red color toner image and another yellow color image were transferred on the back surface of the sheet of plain paper and the sheet of plain paper having the other full color toner images on the back surface was carried to the fixing unit and fixed there to obtain the other full color toner image. The full color image was as good as that on the front surface.

Full color images were copied on both the front and back surfaces of 5000 normal sheets of plain paper. In this case, the carriage fault and transfer fault were not caused with respect to the normal sheets of paper and contamination of the surfaces of the transfer drum and the photoconductor drum by dimethyl silicone oil was very little. In addition, offset development was not caused in the heating, pressing and fixing process for not only the front surface of the sheet of plain paper but also the back surface thereof.

COMPARISON EXAMPLE 1

The same processes as in example 1 were performed in place of classifying conditions of fine powder and coarse particles in the multidivision classifying apparatus and cyanine blue color toner of a weight average particle size of 8.14 μm was obtained with toner particles of 4 μm or less in particle size being 6.5% by number, toner particles of 5.04

μm or less in particle size being 13.6% by number, toner particles of 8 μm or more in particle size being 46.7% by volume, and toner particles of 10.08 μm or more in particle size being 11.9% by volume.

The two component type developer having the cyanine blue color toner and hydrophobic titanium oxide fine powder externally added thereto was prepared as in example 1 provided in the cyanine blue color developing unit 27C. Then, as in example 1, the image coloring test was performed. In this case, although the curling of the sheet of plain paper was less, the highest image density of the cyanine blue color image was only 1.5 and at that time the amount of cyanine blue color toner held in the highest density region on the sheet of plain paper was 0.75 mg/cm$^2$.

When the development condition was changed so that the amount of the cyanine blue color toner held in the highest image density region of the sheet of plain paper was 1.3 mg/cm$^2$, a cyanine blue color image could be obtained with the highest image density of 2.0. However, the curling of the sheet of plain paper was very severe so that it was difficult to carry the curled sheet of plain paper to form another cyanine blue color image on the back surface thereof.

COMPARISON EXAMPLE 2

As in the comparison example 1, the same processes as in example 1 were performed with use of quinacridone pigment in place of phtalocyanine pigment and magenta red color toner of a weight average particle size of 8.53 μm obtained with the toner particles of 4 μm or less in particle size being 10.2% by number, toner particles of 5.04 μm or less in particle size being 23.5% by number, toner particles of 8 μm or more in particle size being 53.9 by volume, and toner particles of 10.08 or more in particle size being 12.8% by volume.

Next, a two component type developer having the magenta red color toner and hydrophobic titanium oxide fine powder externally added thereto was prepared as in example 1.

Further, like in comparison example 1, the same processes as in example 1 were performed with use of C.I. Pigment yellow 17 in place of phtalocyanine pigment and yellow color toner of a weight average particle size of 8.31 μm was obtained with toner particles of 4 μm or less in particle size being 8.0% by number, toner particles of 5.04 μm or less in particle size being 20.5% by number, toner particles of 8 μm or more in particle size being 50.0% by volume, and toner particles of 10.08 μm or more in particle size being 12.1 by volume.

Next, a two component type developer having the yellow color toner and hydrophobic titanium oxide fine powder externally added thereto was prepared as in example 1.

Next, a two component type developer which included a cyanine blue color toner to which the hydrophobic titanium oxide fine powder prepared in the comparison example 1 was added, was provided in the cyanine blue color developing unit 27C. Further, the developers prepared above were provided in the magenta color developing unit 27M and the yellow color developing unit 27Y. Then, in a full color mode a cyanine color toner image, a magenta color toner image, and a yellow color toner image were transferred on the front surface of a sheet of plain paper which was heated, pressed and fixed by the fixing unit, as in example 1, so that a full color image was formed on the front surface of the sheet of plain paper. A total amount of cyanine color toner particles, magenta color toner particles and yellow color toner particles held in the region of the highest image density was 2.2 mg/cm$^2$. After passing through the fixing unit, the sheet of plain paper curled so much that it was difficult to carry the sheet of plain paper to the image forming section for a copy on the back surface of the sheet of plain paper.

EXAMPLE 3

A two component type developer was prepared which included cyanine blue color toner to which hydrophobic silica fine powder was added, in the same manner as in example 1, except that hydrophobic silica fine powder (BET specific surface area: 140 m$^2$/g) treated with dimethyl dichlorosilane was used as an additive agent in place of the hydrophobic titanium oxide fine powder. The obtained two component type developer was introduced into the cyanine color developing unit 27C and then a double side copy was performed as in example 1. In this case, although it was observed that the surfaces of the transfer drum 15 and the photoconductor drum 19 were contaminated gradually with dimethyl silicone oil as the number of copies increases, deleterious influence to the image formation could be found until 6000 sheets of paper. However, a negative influence to the image formation due to contamination by dimethyl silicone oil appeared on the cyanine color image when 6000 sheets were exceeded.

What is claimed is:

1. An image forming method, comprising the steps of:

forming a first unfixed image of color toner on one side of a transfer material, wherein said color toner has a weight average particle size of 3 to 7 μm and includes color toner particles having a particle size of 4 μm or less in a range of 10 to 70% by number, color toner particles having a particle size of 5.04 μm or less in a range of 40% by number or more, color toner particles having a particle size of 8 μm or more in a range of 2 to 20% by volume, and color toner particles having a particle size of 10.08 μm or more in a range of 6% by volume or less;

heating and melting said color toner of said first unfixed image by heating, pressing and fixing means which includes a rotation body for fixing having an elastic layer to fix said first unfixed image to said one side of said transfer material;

forming a second unfixed image of color toner on the other side of said transfer material, wherein said color toner has a weight average particle size of 3 to 7 μm and includes color toner particles having a particle size of 4 μm or less in a range of 10 to 70% by number, color toner particles having a particle size of 5.04 μm or less in a range of 40% by number or more, color toner particles having a particle size of 8 μm or more in a range of 2 to 20% by volume, and color toner particles having a particle size of 10.08 μm or more in a range of 6% by volume or less; and heating and melting said color toner of said second unfixed image by said heating, pressing and fixing means to fix said second unfixed image to said other side of said transfer material, whereby color images are formed on both sides of said transfer material.

2. The image forming method according to claim 1, wherein said color toner includes color toner particles having a particle size of 4 μm or less in a range of 15 to 60% by number, color toner particles having a particle size of 5 μm or less in a range of 40% by number or more, color toner particles having a particle size of 8 μm or more in a range of 3.0 to 18.0% by volume, and color toner particles having a particle size of 10.08 μm or more in a range of 4% by volume or less.

3. The image forming method according to claim 1, wherein said first unfixed image of said color toner is transferred onto the one side of said transfer material held by a transfer drum from a surface of a photoconductor drum, said transfer material having said first unfixed image of the color toner is carried to said heating, pressing and fixing means, said first unfixed image of the color toner on said transfer material is subjected to a heating, pressing and fixing operation to form a color image on the one side of said transferred material, said transfer material is returned to the transfer drum having said second unfixed image on the surface thereof, said second unfixed image of the color toner is transferred onto said transfer material from the photoconductor drum surface, said transfer material having said second unfixed image of the color toner on the other side thereof is carried to said heating, pressing and fixing means, and said second unfixed image of the color toner on the other side of said transfer material is subjected to the heating, pressing and fixing means to form the second color image on the other side of said transfer material, said transfer material having color images formed on both sides.

4. The image forming method according to claim 3, wherein said heating, pressing and fixing means includes a fixing roller and a pressing roller, and wherein a releasing agent is supplied to the surface of said fixing roller by releasing agent coating means.

5. The image forming method according to claim 4, wherein said releasing agent coating means is an oil coating unit, and wherein an oil is coated on the surface of said fixing roller.

6. The image forming method according to claim 5, wherein the oil is silicone oil.

7. The image forming method according to claim 4, wherein each of said fixing roller and said pressing roller includes a heater.

8. The image forming method according to claim 7, wherein said fixing roller and said pressing roller are heat-controlled by a control unit.

9. The image forming method according to claim 8, wherein said fixing roller and said pressing roller are controlled at substantially the same temperature.

10. The image forming method according to claim 1, wherein said color toner is cyanine blue color toner, magenta red color toner or yellow color toner.

11. The image forming method according to claim 10, wherein each of said first unfixed image and said second unfixed image is formed of cyanine blue color toner, magenta red color toner and yellow color toner, and said first unfixed image and said second unfixed image are formed on respective sides of said transfer material in full color.

12. The image forming method according to claim 1, wherein color toner in the amount of 1.0 mg or less per 1 $cm^2$ is held on said transfer material in a region of highest image density.

13. The image forming method according to claim 12, wherein color toner in the amount of 0.8 mg or less per 1 $cm^2$ is held on said transfer material in the region of highest image density.

14. The image forming method according to claim 11, wherein said cyanine blue color toner, said magenta red color toner and said yellow color toner in the amount of 2.3 mg or less per 1 $cm^2$ in total is held on said transfer material in a region of highest image density.

15. The image forming method according to claim 14, wherein said cyanine blue color toner, said magenta red color toner and said yellow color toner in the amount of 2.0 mg or less per 1 $cm^2$ in total is held on said transfer material in the region of highest image density.

16. The image forming method according to claim 15, wherein said cyanine blue color toner, said magenta red color toner and said yellow color toner in the amount of 1.8 mg or less per 1 $cm^2$ in total is held on said transfer material in the region of highest image density.

17. The image forming method according to claim 3, wherein each of said first unfixed image of the color toner and said second unfixed image of the color toner is subjected to a heating, pressing and fixing operation to be fixed to said transfer material at a fixing speed that is slower than a process speed.

18. The image forming method according to claim 1, wherein a hydrophobic titanium oxide fine powder is externally added to said color toner.

19. The image forming method according to claim 18, wherein said hydrophobic titanium oxide fine powder has an average particle size of 0.01 to 0.2 μm.

20. The image forming method according to claim 19, wherein said hydrophobic titanium oxide fine powder has a average particle size of 0.01 to 0.1 μm.

21. The image forming method according to claim 20, wherein said hydrophobic titanium oxide fine powder has a average particle size of 0.01 to 0.07 μm.

22. The image forming method according to claim 18, wherein said hydrophobic titanium oxide fine powder has a hydrophobicity of 20 to 98%.

23. The image forming method according to claim 22, wherein said hydrophobic titanium oxide fine powder has a hydrophobicity of 30 to 90%.

24. The image forming method according to claim 19, wherein said hydrophobic titanium oxide fine powder has a light transmittance of 40% or more at a wavelength of 400 nm.

25. The image forming method according to claim 18, wherein hydrophobic titanium oxide fine powder in the amount of 0.5 to 5 weight % is externally added to said color toner.

26. The image forming method according to claim 25, wherein hydrophobic titanium oxide fine powder in the amount of 0.7 to 3 weight % is externally added to said color toner.

27. The image forming method according to claim 26, wherein hydrophobic titanium oxide fine powder in the amount of 1.0 to 2.5 weight % is externally added to said color toner.

28. The image forming method according to claim 1, wherein said color toner has an apparent viscosity of $5\times10^4$ to $5\times10^6$ poise at a temperature of 90° C. and an apparent viscosity of $1\times10^4$ to $5\times10^5$ poise at a temperature of 100° C.

29. The image forming method according to claim 28, wherein said color toner has an apparent viscosity of $7.5\times10^4$ to $2\times10^6$ poise at a temperature of 90° C. and an apparent viscosity of $1\times10^4$ to $3\times10^5$ poise at a temperature of 100° C.

30. The image forming method according to claim 29, wherein said color toner has an apparent viscosity of $1\times10^5$ to $1\times10^6$ poise at a temperature of 90° C. and an apparent viscosity of $1\times10^4$ to $2\times10^5$ poise at a temperature of 100° C.

* * * * *

UNITED STATES PATENT AND TRADEMARK OFFICE

CERTIFICATE OF CORRECTION

PATENT NO. : 5,529,865 Page 1 of 4

DATED : June 25, 1996

INVENTOR(S) : Makoto KANBAYASHI, et al.

It is certified that error appears in the above-indentified patent and that said Letters Patent is hereby corrected as shown below:

COLUMN 2:

Line 9, "in" should read "in the"; and,
Line 10, "copy" should read --copying--.

COLUMN 3:

Lines 46 and 47, "to adhere to a photoconductor drum faithfully to a fine electrostatic latent image" should read --to adhere to a photoconductor drum to faithfully form a fine electrostatic image--.

COLUMN 4:

Line 19, "for" should read --for a--.

COLUMN 5:

Line 55, "of" should read --of a--.

COLUMN 7:

Line 58, ""C1"" should read --"C1"--.

COLUMN 8:

Line 22, "manner," should read --manner, a--, and "cop" should read --copy--;

UNITED STATES PATENT AND TRADEMARK OFFICE

CERTIFICATE OF CORRECTION

PATENT NO. : 5,529,865 Page 2 of 4

DATED : June 25, 1996

INVENTOR(S) : Makoto KANBAYASHI, et al.

It is certified that error appears in the above-indentified patent and that said Letters Patent is hereby corrected as shown below:

Line 49, "copolymer," should read --copolymer, an--; and,
Line 58, "for" should read --for a--.

COLUMN 9:

Line 48, "C — N should read --C — N
‖ ‖
/N\" /C\--; and,

Line 49, " C should read -- C
// \ // \
N " N --
\\/ \\/
N C

COLUMN 10:

Line 13, "as" should read --as a--;
Line 16, "to" should be deleted;
Line 24, "melt" should read --melted--;
Line 35, "capability but" should read --capability, whereas--; and
Line 47, "are" should read --are a--.

COLUMN 12:

Line 37, "of" should read --of the--; and,
Line 59, "preferable" should read --preferably--

UNITED STATES PATENT AND TRADEMARK OFFICE

CERTIFICATE OF CORRECTION

PATENT NO. : 5,529,865 Page 3 of 4

DATED : June 25, 1996

INVENTOR(S) : Makoto KANBAYASHI, et al.

It is certified that error appears in the above-indentified patent and that said Letters Patent is hereby corrected as shown below:

COLUMN 13:

Line 31, "of" should read --of a--;
Line 39, "10.08 μm" should read --10.08 μm,--; and,
Line 41, "respectively" should read --respectively.--.

COLUMN 14:

Line 35, "liminary" should read --liminarity--.

COLUMN 15:

Line 31, "would" should read --wound--; and,
Line 55, "phtalocyanine" should read --phthalocyanine--.

COLUMN 16:

Line 3, "phtalocyanine" should read --phthalocyanine--;
Line 30, "toner and," should read --toner, and--; and,
Line 40, "would" should read --wound--.

COLUMN 17:

Line 28, "phtalocyanine" should read --phthalocyanine--;

UNITED STATES PATENT AND TRADEMARK OFFICE

CERTIFICATE OF CORRECTION

PATENT NO. : 5,529,865 Page 4 of 4

DATED : June 25, 1996

INVENTOR(S) : Makoto KANBAYASHI, et al.

It is certified that error appears in the above-indentified patent and that said Letters Patent is hereby corrected as shown below:

Line 33, "53.9" should read --53.9%--;
Line 34, "10.08" should read --10.08 μm--;
Line 42, "phtalocyanine" should read --phthalocyanine--; and,
Line 48, "12.1" should read --12.1%--.

COLUMN 18:

Line 22, "deletirious" should read --no deleterious--.

COLUMN 20:

Line 23, "a" should read --an--; and
Line 26, "a" should read --an--.

Signed and Sealed this

Fifteenth Day of July, 1997

*Attest:*

*Attesting Officer*

BRUCE LEHMAN

*Commissioner of Patents and Trademarks*